US008608160B2

(12) United States Patent
Shinagawa et al.

(10) Patent No.: US 8,608,160 B2
(45) Date of Patent: Dec. 17, 2013

(54) RECORDING APPARATUS

(75) Inventors: Yu Shinagawa, Shiojiri (JP); Hiroki Chino, Matsumoto (JP); Yosuke Nakano, Shiojiri (JP); Tetsuya Tamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 202 days.

(21) Appl. No.: 13/170,231

(22) Filed: Jun. 28, 2011

(65) Prior Publication Data

US 2011/0316224 A1 Dec. 29, 2011

(30) Foreign Application Priority Data

Jun. 28, 2010 (JP) ..... 2010-146230

(51) Int. Cl.
*B65H 1/00* (2006.01)

(52) U.S. Cl.
USPC ..... 271/162; 271/145; 271/245; 271/164

(58) Field of Classification Search
USPC ..... 271/162, 145, 164, 245
See application file for complete search history.

(56) References Cited

U.S. PATENT DOCUMENTS

| | | | | |
|---|---|---|---|---|
| 6,824,132 | B2 | 11/2004 | Asai et al. | |
| 6,984,084 | B2 | 1/2006 | Ng et al. | |
| 7,455,287 | B2 | 11/2008 | Shiohara et al. | |
| 7,828,285 | B2 | 11/2010 | Chu et al. | |
| 8,083,222 | B2 | 12/2011 | Nakano | |
| 8,226,083 | B2 | 7/2012 | Yanagishita | |
| 8,356,810 | B2 * | 1/2013 | Aruga et al. | 271/124 |
| 2002/0025196 | A1 * | 2/2002 | Matsumoto et al. | 399/258 |
| 2004/0245703 | A1 | 12/2004 | Yun et al. | |
| 2004/0251592 | A1 | 12/2004 | Ruhe et al. | |
| 2006/0236331 | A1 | 10/2006 | Ueda et al. | |
| 2011/0074090 | A1 | 3/2011 | Yanagishita | |
| 2011/0156339 | A1 | 6/2011 | Nakano | |
| 2011/0292148 | A1 | 12/2011 | Shinagawa et al. | |

FOREIGN PATENT DOCUMENTS

| | | |
|---|---|---|
| JP | 2000-335769 A | 12/2000 |
| JP | 2005-008416 | 1/2005 |
| JP | 2006-124131 | 5/2006 |

OTHER PUBLICATIONS

U.S. Appl. No. 13/172,155, filed Jun. 29, 2011, Shinagawa et al.
U.S. Appl. No. 13/170,418, filed Jun. 28, 2011, Shinagawa et al.
U.S. Appl. No. 13/231,538, filed Sep. 13, 2011, Aruga et al.
U.S. Appl. No. 13/170,418, Mail Date Aug. 10, 20112, Office Action.
U.S. Appl. No. 13/172,155, Mail Date Aug. 15, 2012, Office Action.
U.S. Appl. No. 13/231,538, Mail Date Sep. 5, 2012, Notice of Allowance.

* cited by examiner

*Primary Examiner* — Michael McCullough
*Assistant Examiner* — Howard Sanders
(74) *Attorney, Agent, or Firm* — Workman Nydegger

(57) ABSTRACT

A recording apparatus includes a slider that has a cam face with which a cam of the stopper comes into sliding contact and moves in the insertion direction from a first position to a second position with a resistance when the cassette is inserted into the mounting unit. The cam face includes a first cam face on which the cam slides when the slider moves from the first position to the second position and a press cam face against which the cam presses when the paper sheet comes into contact with the stopper. The press cam face has an inclination relative to a reference straight line which is perpendicular to a plane parallel to the insertion direction of the cassette which is greater than that relative to a straight line which extends from the contact point between the press cam face and the cam to the shaft.

6 Claims, 7 Drawing Sheets

RECORDING APPARATUS

The entire disclosure of Japanese Patent Application No: 2010-146230, filed Jun. 28, 2010 is expressly incorporated by reference herein.

BACKGROUND

1. Technical Field

The present invention relates to recording apparatuses.

2. Related Art

Ink jet printers (hereinafter simply referred to as "printers") that eject ink from a recording unit such as a recording head onto a paper sheet so as to record a certain image (including characters and graphics) are an example of a type of recording apparatus that ejects liquid such as ink onto a recording medium such as a paper sheet so as to perform a recording operation.

Such printers are provided with a feeding cassette containing a plurality of stacked paper sheets therein (hereinafter simply referred to as a "cassette") and are configured to record images on the paper sheets while feeding the uppermost paper sheets one by one toward the recording unit. Accordingly, the printers include a mounting unit in which the cassette containing a plurality of stacked paper sheets therein is detachably mounted by inserting the cassette in a direction perpendicular to a stack direction of the paper sheets and a paper feeding roller that separates the paper sheets one by one and feeds out the separated paper sheets from the cassette in a mounted state in the mounting unit toward the recording unit in a sequential manner.

The printer further includes a separation slope that is disposed at the internal end face of the mounting unit in which the cassette is mounted, that is, at a position opposite the front end of the cassette in a mounted state in the mounting unit in the insertion direction. The separation slope is formed to guide the paper sheets toward the recording unit when the paper feeding roller separates the paper sheets one by one and feeds out the separated paper sheets from the cassette.

Since the cassette is mounted in the mounting unit by a user, when the cassette is inserted into the mounting unit at a rapid speed, some of the paper sheets stacked in the cassette may be urged in the insertion direction by the inertia force and may be disposed on the rising separation slope. As a consequence, the separation slope fails to separate the paper sheets one by one, thereby causing a double feeding state in which two or more paper sheets are fed together. This may cause a problem such as a paper jam.

JP-A-2000-335769 discloses a mechanism for preventing the above-mentioned problem, in which a shutter member that moves downward from a retreat position in an upper region to a control position in a lower region is provided so that the shutter member controls the movement of the end of the paper sheets downstream in the feeding direction (hereinafter referred to as a "leading edge of the paper sheets") in the insertion direction of the cassette. The lower end of the shutter member is configured to rotate upstream in the feeding direction when the shutter member moves up from the control position in the lower region where the shutter member abuts the leading edge of the respective paper sheets to the retreat position in the upper region. With this configuration, the shutter member permits the leading edge of the respective paper sheets abutting the shutter member and to be aligned with the slope surface such that the leading edge of the paper sheet in the higher position in the stack comes to a position more downstream in the feeding direction.

However, with the configuration disclosed in JP-A-2000-335769, a space for providing a rotation mechanism and a slide mechanism for sliding the shutter member into the retreat position while rotating the shutter member is needed. In addition, a space for housing the shutter member, the rotation mechanism and the slide mechanism is also needed. Those spaces cause a problem in that the printer becomes large.

In order to solve the above problem, for example, a configuration using a control member that has a control surface to control the movement of the paper sheet in the forward direction of the insertion direction of the cassette and that rotates to turn over in the insertion direction has been proposed. That is, in this case, the movement of the paper sheet is controlled by the control surface and the momentum of the paper sheet is reduced, and then, the control of the movement of the paper sheet is released when the control surface rotates so as to retreat from the separation slope with a predetermined time delay.

With this configuration, the paper sheets are separated one by one and guided to the recording unit without being disposed on the separation slope. As a result, only a space for a rotation movement mechanism of the control member is required without having to provide a wide space for housing a shutter member, a rotation mechanism and slide mechanism into the retreat position, therefore it is possible to prevent a printer from becoming large.

During such a rotation movement of the control member, a damper member is used to cause a predetermined time delay after controlling the movement of the paper sheets. That is, since a movement member of the damper member moves with a resistance, a time delay is generated between the time when the movement of the paper sheets is controlled and the time when the control is released by the rotation movement of the control member.

In such a damper member, since the control member moves cooperatively with the moving member, the control member has a cam that comes into sliding contact with a cam face of the moving member. However, when the paper sheets strongly collide against the control surface of the control member, the moving member fails to fully support the control member and is forced to move immediately without generating a predetermined time delay for the rotation operation of the control member. That is, the control member cannot resist the impact of the paper sheets and is forced to rotate to the release position and releases the control of the movement of the paper sheets before fully controlling the movement of the paper sheets. This results in a problem in that the control member fails to fully control the movement of the paper sheets.

SUMMARY

An advantage of an aspect of the invention is that a damper device, a transportation device and a recording apparatus capable of fully controlling the movement of the object by using a control member is provided.

According to an aspect of the invention, a recording apparatus includes a control member that is configured to be rotatable about a shaft and controls the movement of an object contained in a container by coming into contact with the object when the object moves in an insertion direction from the container and a damper member that rotates the control member from a control position where the movement of the object is controlled to a release position where the control of the movement of the object is released with a time delay, the damper member including a moving member that has a cam face with which a cam of the control member comes into sliding contact and moves in the insertion direction from a first position to a second position with a resistance when the container is inserted into the mounting unit, wherein the cam face includes a first cam face on which the cam slides when the moving member moves from the first position to the second position and a press cam face that is arranged so as to oppose the first cam face and against which the cam presses when the object comes into contact with the control member, and the press cam face has an inclination relative to a reference straight line which is perpendicular to a plane parallel to the insertion direction of the container which is greater than that relative to a straight line which extends from the contact point between the press cam face and the cam to the shaft.

Accordingly, the component of the force that acts in the moving direction of the moving member of the force which is exerted by the cam on the press cam face due to the impact of the control member coming into contact with the object is reduced. Therefore, the movement of the moving member in the insertion direction by the force exerted by the cam on the press cam face due to the impact of the object coming into contact with the control member is restrained, and accordingly, the rotation of the control member to the release position due to the impact of the object coming into contact with the control member is restrained. As a result, it is possible for the control member to fully control the movement of the object.

According to the recording apparatus of the invention, an angle between the press cam face and the reference straight line is 90 degrees or less. Accordingly, when the moving member moves from the first position to the second position, the cam pressing against the press cam face can smoothly move to the first cam face so as to come into contact with the first cam face.

According to the recording apparatus of the invention, the press cam face is flat. Accordingly, variations in shape of the press cam face can be reduced. According to the recording apparatus of the invention, the moving member includes a second cam face on which the cam is guided to the press cam face when the moving member moves from the second position to the first position.

Accordingly, the cam slides on the second cam face to the press cam face when the moving member moves from the second position to the first position, therefore the control member can smoothly move from the release position to the control position.

According to the recording apparatus of the invention, an angle between the second cam face and the reference straight line is smaller than the angle between the press cam face and the reference straight line. Accordingly, the amount of rotation of the control member from the release position to the control position can be obtained with a relatively small amount of movement of the movement member.

According to the recording apparatus of the invention, the press cam face and the second cam face are continuous. Accordingly, the size of the moving member can be reduced and the number of components constituting the moving member can by reduced compared with the case where the press cam face and the second cam face are formed spaced from each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
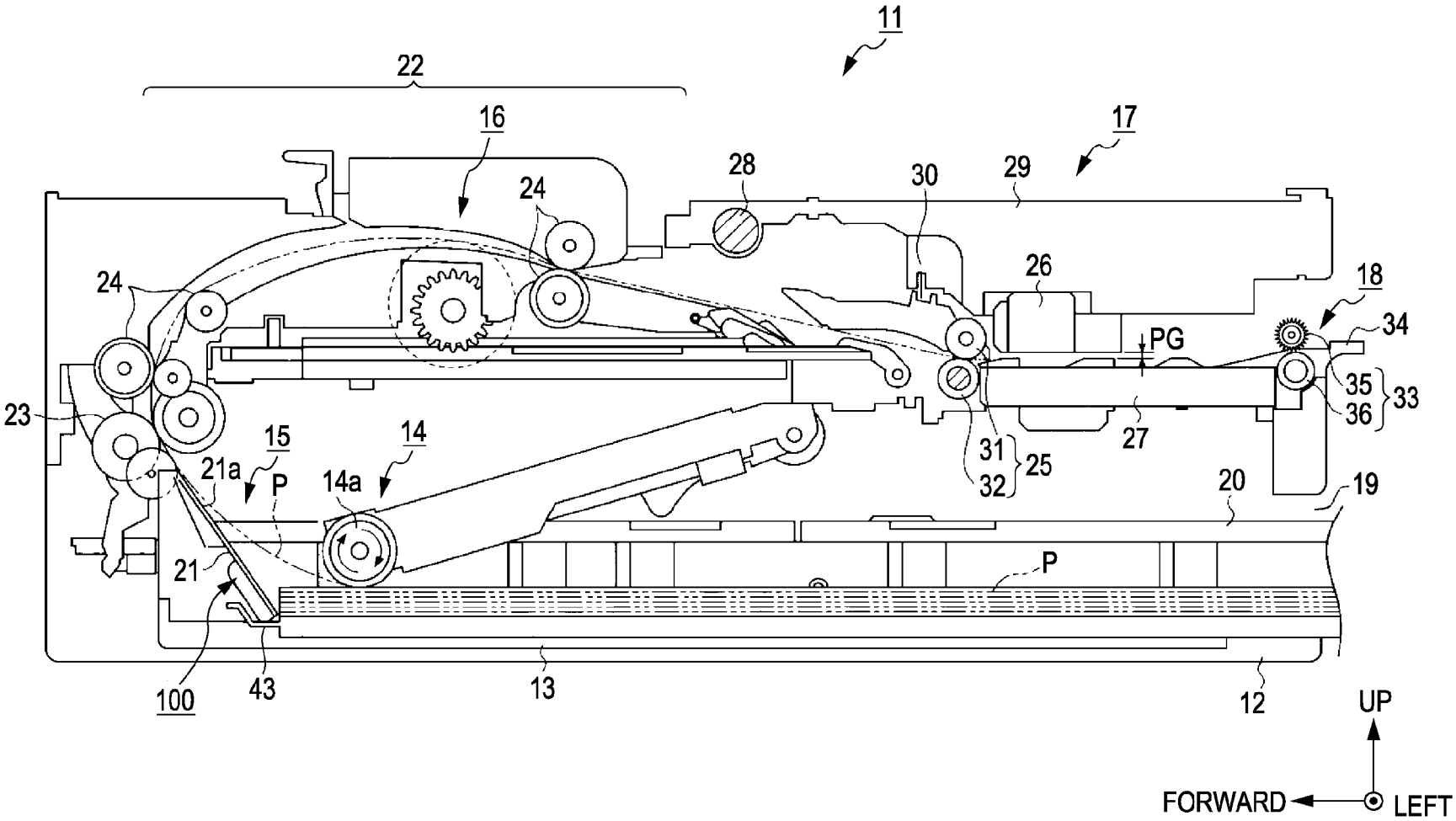
FIG. 1 is a schematic configuration view of an ink jet printer according to an embodiment.

With reference to the drawings, a damper member of the present invention will be described below according to an embodiment of an ink jet printer as a recording apparatus including a transportation device having such a damper member. The terms "forward-backward direction", "left-right direction" and "up-down direction" as used herein refer to the forward-backward direction, left-right direction and up-down direction indicated in FIG. 1, respectively. In FIG. 1, a direction perpendicular to the plane of the drawing is the left-right direction and the direction towards the front side of the plane of the drawing is the left direction.

As shown in FIG. 1, an ink jet printer 11 as an example of a recording apparatus includes a mounting unit 13, a feeding unit 14, a separation unit 15, a transportation unit 16 as an example of a transportation device, a recording unit 17 and a discharge unit 18 within a frame 12 formed as a housing. The above are arranged in sequence along the transportation path for a paper sheet P as an example of an object of a recording operation in the ink jet printer 11.

First, the mounting unit 13 is disposed in a lower area in the frame 12 and communicates with the outside of the frame 12 via an insertion port 19 which is open on the rear side of the frame 12 in a rectangular shape. A cassette 20 serving as a rectangular container in which a plurality of stacked paper sheets P are loaded is inserted into and/or removed from the insertion port 19 in a direction (forward-backward direction) which is perpendicular to the stack direction of the paper sheets P (up-down direction), such that the paper sheets P can be removably mounted in the mounting unit 13 together with the cassette 20.

Next, the feeding unit 14 is disposed in the frame 12 at a position corresponding to the internal end face of the mounting unit 13. The feeding unit 14 is also provided with a pick-up roller 14*a* that rotates in response to a driving force of a feed motor, which is not shown. The rotation of the pick-up roller 14*a* feeds the uppermost paper sheet P of the stacked paper sheets P loaded on the cassette 20, which has been inserted in the mounting unit 13 through the insertion port 19, in a direction away from the insertion port 19 (forward direction).

Further, the separation unit 15 is disposed in the frame 12 at a position opposite the front end of the cassette 20 in a mounted state in the mounting unit 13 in the insertion direction (forward direction). The separation unit 15 is also provided with an inclined plate 21 which forms a rising surface as seen from the mounting unit 13. In the separation unit 15, the paper sheet P which has been fed from the feeding unit 14 is advanced over a separation slope 21*a* that is formed by the surface of the inclined plate 21 with the leading edge of the paper sheet P abutting the separation slope 21*a* such that the paper sheet P is separated from the stack and fed downstream toward the transportation unit 16.

As shown in FIG. 1, the transportation unit 16 is disposed in the frame 12 so as to form a reverse transportation path 22 in which the paper sheet P which has been fed from the separation unit 15 is reversed and transported toward the recording unit 17 which is located in the upper area in the frame 12. Further, a separation roller 23 is arranged in the upstream region in the reverse transportation path 22 and a plurality of intermediate transportation rollers 24 as transport means are arranged downstream of the separation roller 23 in the reverse transportation path 22, spaced apart from each other in the transportation direction.

The separation roller 23 works to separate the paper sheets P which have been sent together without being separated by the separation slope 21*a*, thereby ensuring that the paper sheets P are fed one by one toward the downstream region where the intermediate transportation rollers 24 are disposed. Each of the intermediate transportation rollers 24 rotates to transport the paper sheet P in a reverse transportation direction (backward direction) which is opposite to the feeding direction from the cassette 20 to the separation unit 15 (forward direction) such that the paper sheet P is transported to the recording unit 17 while being reversed.

Further, the recording unit 17 is disposed in the upper area in the frame 12 as mentioned above and provided with a pair of transportation rollers 25, a recording head 26 and a support member 27 which serves as a support base for the paper sheet P. The recording head 26 is secured to a carriage 29 that is movable in a reciprocating manner along a guide shaft 28 in the width direction (left-right direction) which is perpendicular to the transportation direction of the paper sheet P. The carriage 29 is actuated by drive means which is not shown (for example, a carriage motor) so as to move in a main scan direction (left-right direction) along the guide shaft 28. The position of the carriage 29 in the scan direction is detected by a position detector (encoder) 30 so that the actuating state of the carriage 29 can be controlled.

Once the paper sheet P is fed to the recording unit 17 having the above mentioned configuration, the paper sheet P is transported in a backward direction which is perpendicular to the main scan direction by way of the rotation of a driving transportation roller 32 which constitutes the pair of transportation rollers 25 with a driven transportation roller 31 while being pinched between the transportation rollers 31 and 32, and then fed into a space between the recording head 26 and the support member 27.

The paper sheet P is advanced while being pressed against the support member 27 such that a gap PG is formed relative to the recording head 26. In this state, the recording head 26 moves in the main scan direction (left-right direction) which is the width direction of the paper sheet P in accordance with the movement of the carriage 29. During this movement, a printing operation (a recording operation) is performed by ejecting ink in liquid form through nozzles onto the paper sheet P which is spaced apart from the recording head 26 by the gap PG. The paper sheet P on which the printing operation has been performed is then transported to the discharge unit 18.

The discharge unit 18 has a pair of discharge rollers 33 and a discharge stacker 34. The paper sheet P is transported downstream in the transportation direction (backward direction in FIG. 1) by way of the rotation of a driving discharge roller 36 which constitutes a pair of discharge rollers 33 with a driven discharge roller 35 in a gear shape while being pinched between the discharge rollers 35 and 36, and then discharged onto a discharge stacker 34.

As shown in FIG. 1, the ink jet printer 11 according to this embodiment includes a damper member 100 in an area where the paper sheets P are fed from the cassette 20 toward the separation unit 15 by way of the rotation of the pick-up roller 14*a* while being separated one by one by using the separation slope 21*a* and transferred to the transportation unit 16.

Figure 2:
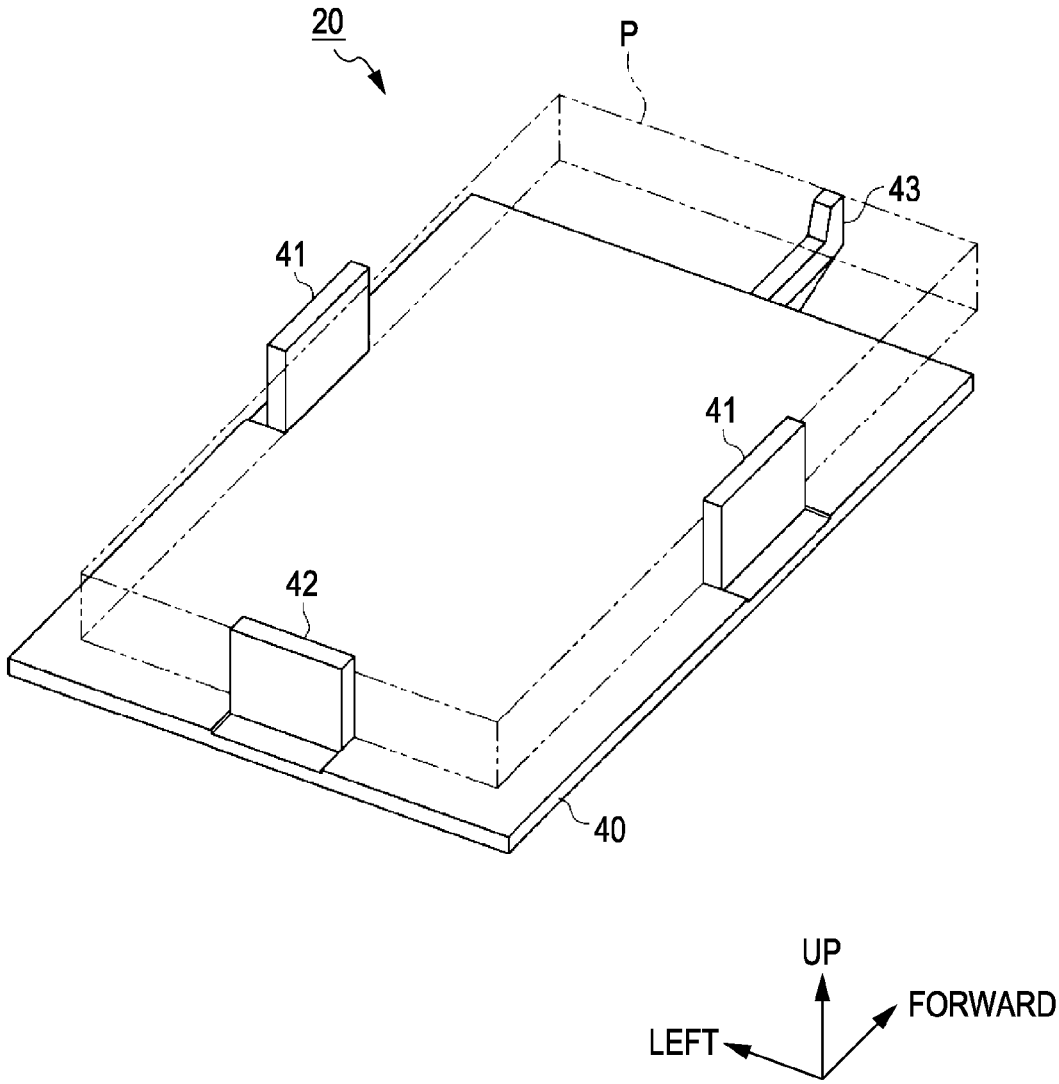
FIG. 2 is a perspective view of a cassette in the printer of FIG. 1.

Next, the configuration of the cassette 20 will be described below in detail. As shown in FIG. 2, the cassette 20 has a cassette body 40 formed as a rectangular plate. A pair of width direction edge guides 41 are erected on the left and right sides on the top of the cassette body 40 so as to control the movement of the paper sheet P in the width direction. Both the width direction edge guides 41 are slidably movable in the width direction of the paper sheets P (left-right direction) so as to adjust the distance therebetween for the width of the paper sheet P loaded on the cassette 20.

Further, a rear edge guide 42 is also erected on the top of the cassette body 40 so as to control the movement of the paper sheet P in the backward direction. The rear edge guide 42 is slidably movable in the forward-backward direction so as to adjust the position thereof for the length of the paper sheet P in the forward-backward direction loaded on the cassette 20. Moreover, a projection 43 which extends forward is formed on the front face of the cassette body 40 to the right of the center in the left-right direction. The tip (front end) of the projection 43 is bent upward.

Figure 3:
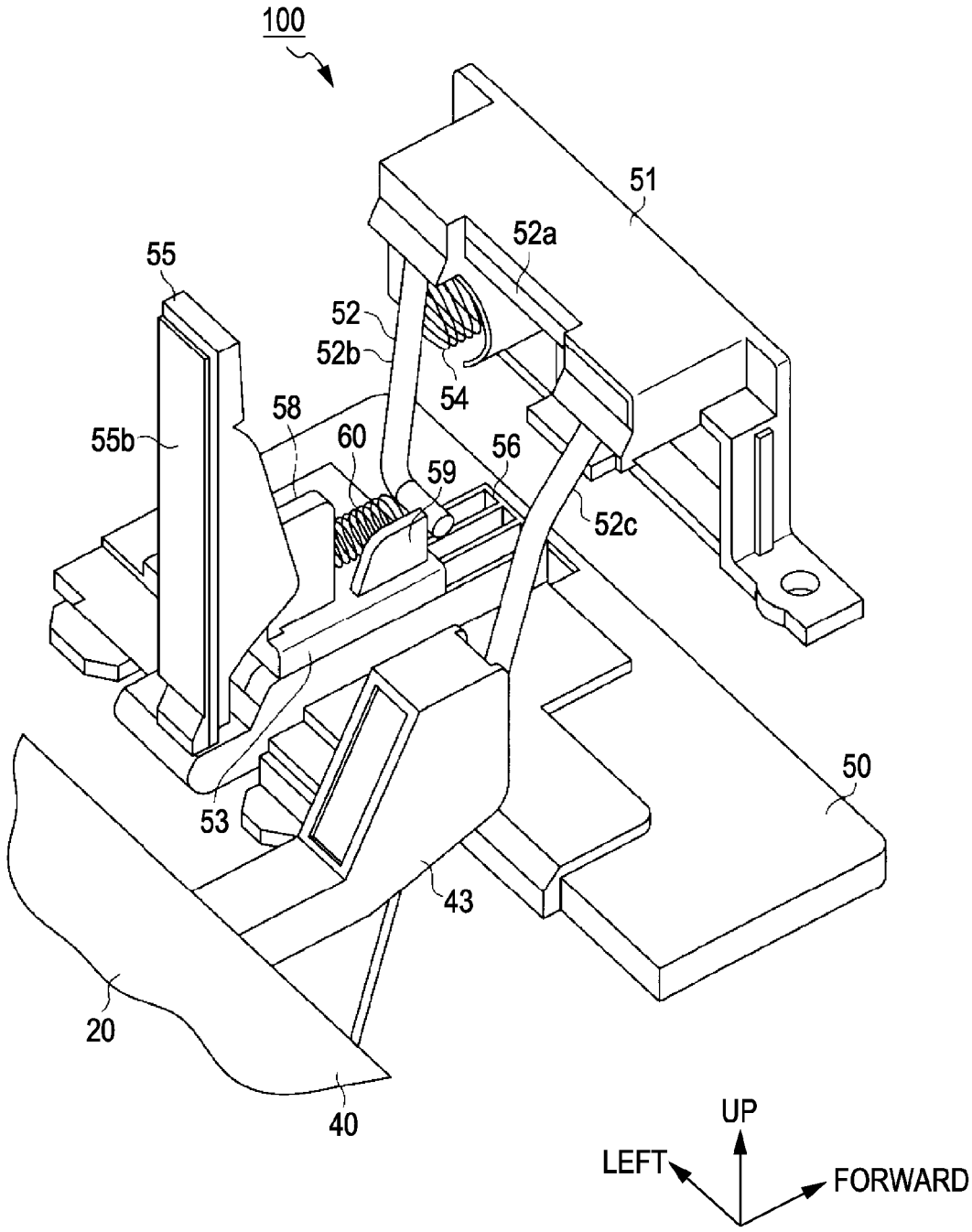
FIG. 3 is a perspective view of a damper member in the printer of FIG. 1.

Next, the configuration of the damper member 100 will be described below in detail. As shown in FIG. 3, the damper member 100 includes a seat portion 50 formed in a substantially rectangular shape, a lever receiving section 51 arranged above the seat portion 50, a lever member 52 that is rotatably supported by the lever receiving section 51 and a slider 53 as a moving member that is arranged on the seat portion 50 to be slidably movable in the forward-backward direction.

Figure 4:
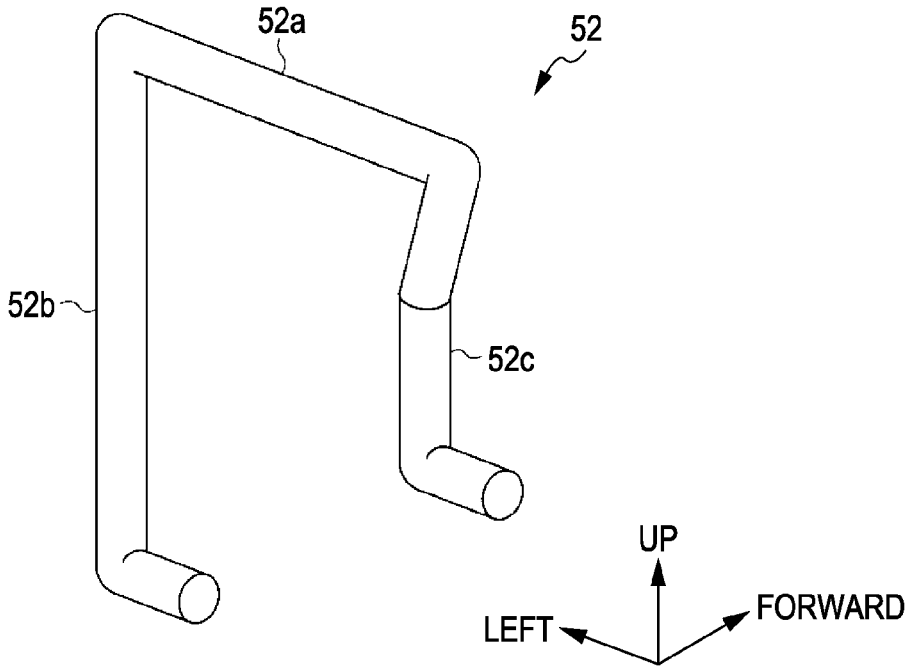
FIG. 4 is a perspective view of a lever member which constitutes the damper member in the printer of FIG. 1.

As shown in FIGS. 3 and 4, the lever member 52 has a supported shaft 52*a* that extends in the left-right direction and is rotatably supported by the lever receiving section 51, a first lever 52*b* that extends downward from the left end of the supported shaft 52*a* and a second lever 52*c* that extends downward from the right end of the supported shaft 52*a*. The first lever 52*b* has a length greater than that of the second lever 52*c*. Both the levers 52*b* and 52*c* have a lower end which is bent rightward at a right angle.

The second lever 52*c* has an intermediate portion in the up-down direction which is bent slightly backward. The lower end of the second lever 52*c* is configured to be pressed forward by the projection 43 of the cassette 20 when the cassette 20 is mounted in the mounting unit 13. Moreover, a compression coil spring 54 is arranged on the rear surface of the lever receiving section 51 at a position corresponding to the first lever 52*b* so as to constantly bias the first lever 52*b* in the backward direction.

Figure 5:
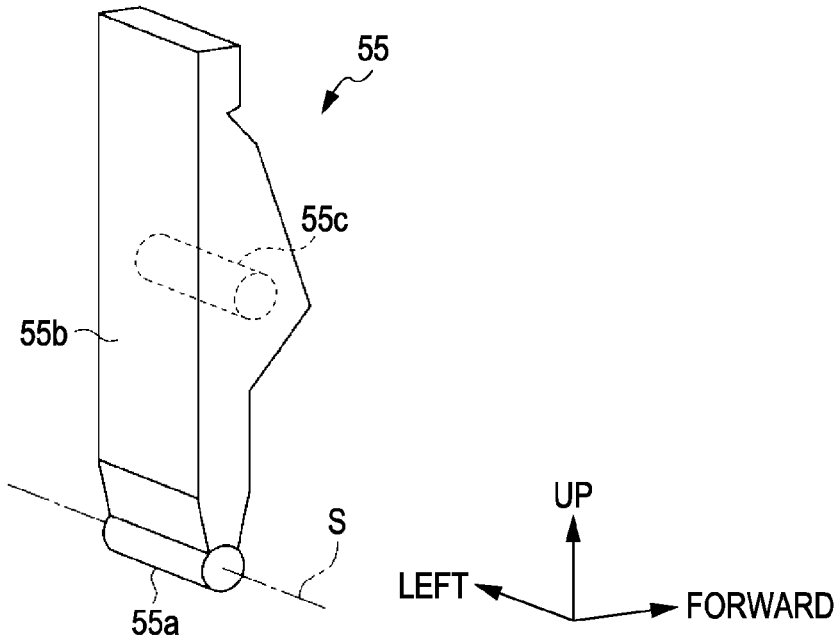
FIG. 5 is a perspective view of a stopper in the printer of FIG. 1.

As shown in FIGS. 3 and 5, a stopper 55 as a control member shaped in a substantially rectangular plate is erected on the top of the seat portion 50 at its rear end at a position opposite the first lever 52*b* in the forward-backward direction.

The stopper 55 has a shaft 55*a* at a lower end thereof in which an axis S extends in the left-right direction such that the shaft 55*a* is rotatably supported by the seat portion 50. As a consequence, the stopper 55 is rotatable about the shaft 55*a* on the seat portion 50. With this configuration, the stopper 55 is not capable of rotating in the backward direction.

On the rear surface of the stopper 55, a control surface 55*b* having a rectangular shape is provided so as to come into contact with the paper sheet P moving in the forward direction, that is, the insertion direction of the cassette 20 when the cassette 20 is inserted into the mounting unit 13, thereby controlling the movement of the paper sheet P. A substantially cylindrical cam 55*c* which extends in the left-right direction is formed on the front surface of the stopper 55 at a position slightly lower than the center in the up-down direction.

Figure 6:
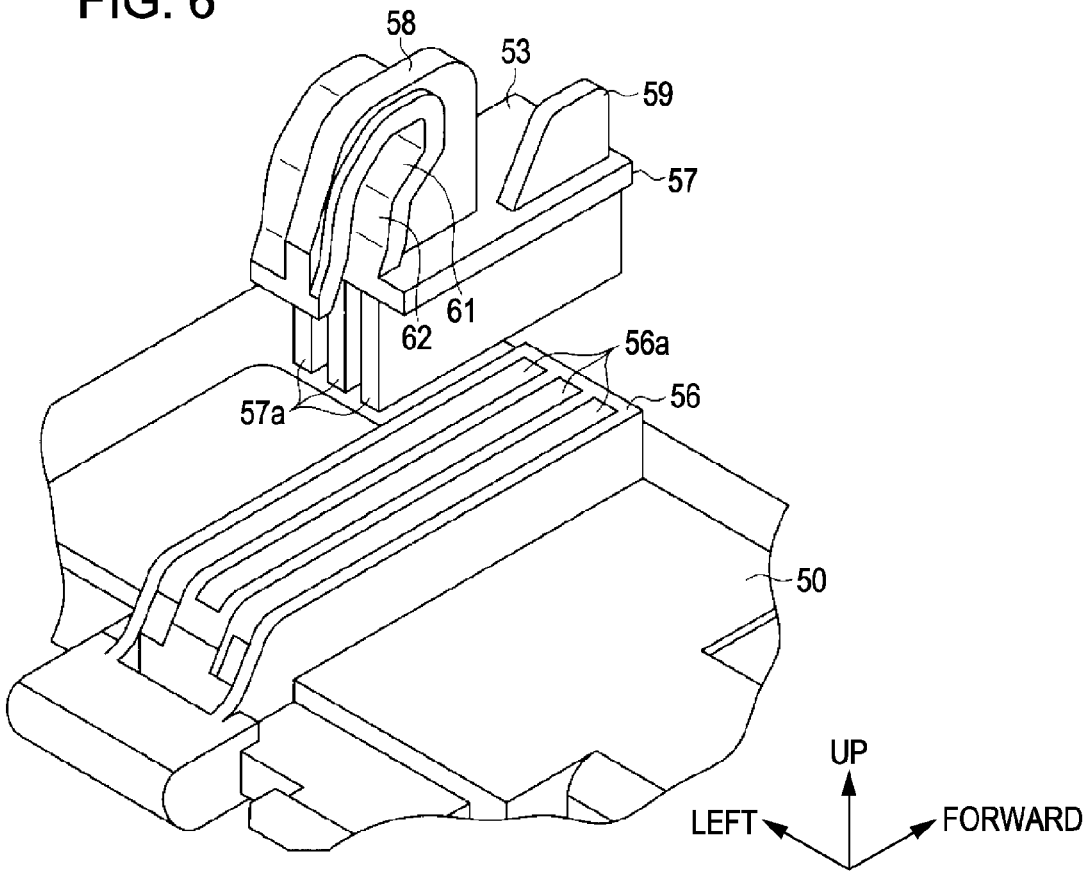
FIG. 6 is a perspective view of the damper member in the printer of FIG. 1, with a slider being removed from a slider support unit.

As shown in FIGS. 3 and 6, a slider support 56 that supports the slider 53 to be slidably movable in the forward-backward direction extends in the forward-backward direction on the seat portion 50 just behind the stopper 55. Three channels 56*a* which extend in the forward-backward direction and which are mutually parallel and spaced apart by equal intervals are formed on the top of the slider support 56. A viscous member such as grease (not shown) is applied on the inner surface of the respective channels 56*a*.

The slider 53 includes a base 57 having a rectangular shape, three slide members 57*a* which extend downward from the underside of the base 57, a cam face constituting member 58 which is arranged on the top of the base 57 at a rear position and an engagement member 59 having a plate shape which is arranged on the top and to the right side of the base 57 so as to engage the lower end of the first lever 52*b*.

The respective slide members 57*a* are formed in rectangular shapes that correspond to the respective channels 56*a* and are slidably inserted into the respective channels 56*a*. When sliding in the channels 56*a*, the slide member 57*a* is subject to resistance of the viscous member (not shown). As a result, in this embodiment, the slider 53 and the slider support 56 serve as a damper.

Figure 7:
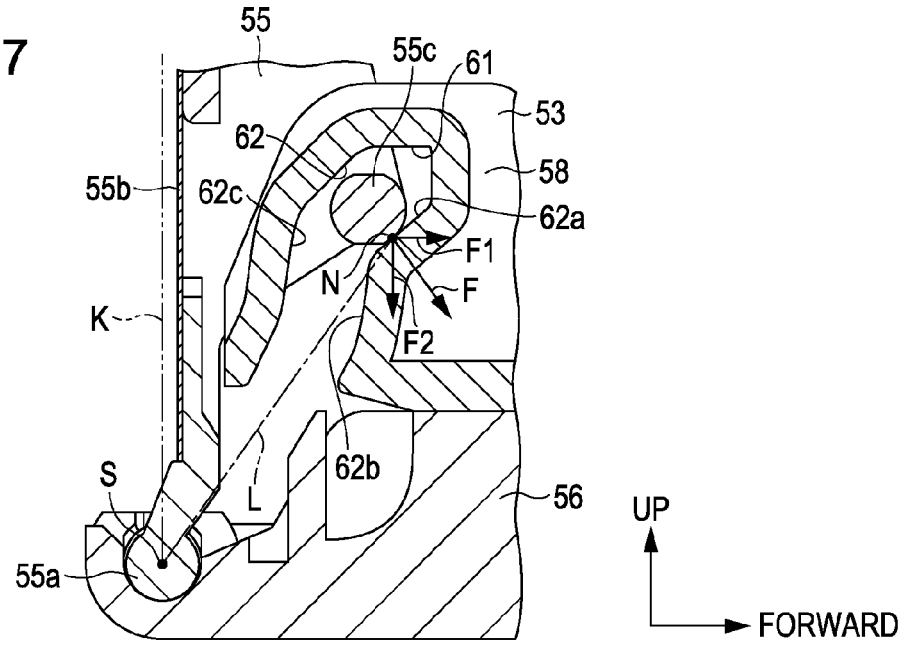
FIG. 7 is an enlarged sectional view of the essential part of the printer of FIG. 1 which shows that the cam presses a press cam face of the slider.

As shown in FIGS. 3, 6 and 7, the front side of the cam face constituting member 58 is connected with the first lever 52*b* via a tension coil spring 60. Further, an incision 61 having a substantially U-shaped section is formed on the rear side of the cam face constituting member 58 so as to be open to the lower, left and right faces of the cam face constituting member 58. The incision 61 is formed to receive the cam 55*c* of the stopper 55 which is inserted thereinto and has an inner surface which serves as a cam face 62 with which the cam 55*c* comes into sliding contact.

As shown in FIG. 7, the cam face 62 includes a press cam face 62*a* having a plate shape with which the cam 55*c* is in contact when the cassette 20 is not mounted in the mounting unit 13, that is, in the first position in which the slider 53 is located at the rear-most position (as shown in FIG. 3), a second cam face 62*b* which continues from the lower side of the press cam face 62*a* and a first cam face 62*c* which opposes both the press cam face 62*a* and the second cam face 62*b*. The position of the stopper 55 when the slider 53 is in the first position is defined as a control position where the movement of the paper sheets P is controlled. When the stopper 55 is positioned in the control position, the control surface 55*b* is parallel with the vertical plane.

The second cam face 62*b* has an upper half and a lower half. The upper half of the second cam face 62*b* is inclined at a slightly greater angle than the lower half of the second cam face 62*b*. Further, for a portion of the first cam face 62*c* which corresponds to the second cam face 62*b*, the upper half of the portion of the first cam face 62*c* is inclined at a slightly greater angle than the lower half of the portion of the first cam face 62*c* similarly to the second cam face 62*b*. The distances between the first cam face 62*c* and each of the press cam face 62*a* and the second cam face 62*b* are slightly greater than the outer diameter of the cam 55*c* and are substantially constant.

The press cam face 62*a* is inclined relative to a straight line L which extends from a contact point N between the cam 55*c* and the press cam face 62*a* to an axis S (rotation center) of the shaft 55*a* at a greater angle than relative to a reference straight line K (a vertical line in this embodiment) which is perpendicular to a plane parallel to the insertion direction (forward direction) of the cassette 20 when inserted into the mounting unit 13 (a horizontal plane in this embodiment). That is, the angle between the reference straight line K and the press cam face 62*a* is greater than the angle between the reference straight line K and the straight line L. While the angle between the reference straight line K and the press cam face 62*a* is generally set to 90 degrees or less (not to exceed 90 degrees), the angle is set to approximately 60 degrees in this embodiment. In addition, the angle between the second cam face 62*b* and the reference straight line K is smaller than the angle between the press cam face 62*a* and the reference straight line K.

Next, the operation of the damper member 100 will be described below in detail. As shown in FIG. 3, when the cassette 20 is not mounted in the mounting unit 13, the slider 53 is in the first position and the stopper 55 is in the control position. Then, when the cassette 20 is rapidly inserted into the mounting unit 13 in the insertion direction through the insertion port 19 with a plurality of stacked paper sheets P being loaded on the cassette 20, the projection 43 of the cassette 20 presses against the lower end of the second lever 52*c* in the forward direction.

Figure 8A:
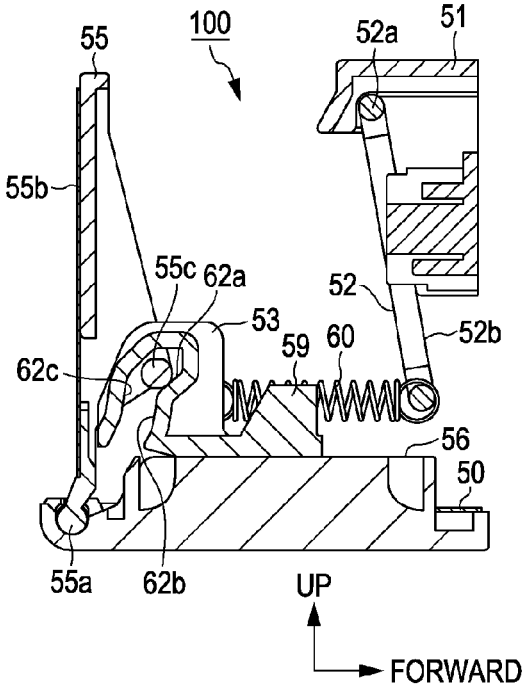
FIGS. 8A to 8D are sectional views which show an operation of a stopper that rotates from a control position to a release position in accordance with the movement of the slider from a first position to a second position.

Then, the lever member 52 resists against a biasing force of the compression coil spring 54 and rotates about the supported shaft 52*a* which serves as a rotation axis in the counterclockwise direction as seen from the right side. This causes the lower end of the first lever 52*b* to move forward while extending the tension coil spring 60 against an elastic force of the tension coil spring 60, as shown in FIG. 8A. As a consequence, the slider 53 is pulled forward along the slider support 56 by a contracting force (elastic force) of the tension coil spring 60. However, due to resistance of the viscous member (not shown) which is placed between each slide member 57*a* and each channel 56*a* of the slider support 56, the slider 53 does not immediately slide forward. That is, there is a slight time delay between a timing when the tension coil spring 60 is extended and a timing when the slider 53 slides forward due to the elastic force caused by the contraction of the tension coil spring 60.

When the paper sheet P moves forward, which is the insertion direction, due to a momentum caused by mounting the cassette 20 in the mounting unit 13, the movement of the paper sheet P is controlled by coming into contact with the control surface 55*b* of the stopper 55. The impact of the paper sheet P coming into contact with the control surface 55*b* causes the stopper 55 to rotate about the shaft 55*a* in a clockwise direction as seen from the right side, thereby causing the cam 55*c* to press against the press cam face 62*a*.

Accordingly, as shown in FIG. 7, when the stopper 55 rotates, a rotational moment acts on the cam 55*c* and a force F of the rotational moment is exerted on the press cam face 62*a*. The force F can be divided into a horizontal component F1 in the forward direction and a vertical component F2 in the lower direction. The vertical component F2 of the force F is greater than the horizontal component F1 of the force F, since the press cam face 62*a* is inclined relative to the reference straight line K at a greater angle than relative to the straight line L.

Accordingly, the horizontal component F1 of the force F that works to move the slider 53 in the forward direction can be reduced, since a substantial part of the force F is allocated as the vertical component F2 to the rigidity of the damper member 100. The impact of the paper sheet P coming into contact with the control surface 55*b* restrains the movement of the slider 53 in the forward direction, thereby restraining the rotation of the stopper 55. As a consequence, the stopper 55 fully restrains the movement of the paper sheet P.

Figure 8B:
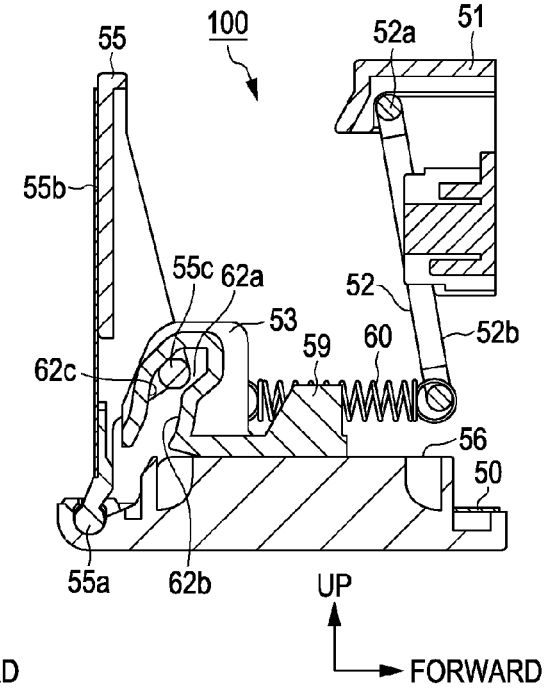

After the movement of the paper sheet P is restrained by the stopper 55, the slider 53 is pulled forward along the slider support 56 due to the contraction of the tension coil spring 60, thereby gradually starting a sliding movement with resistance of the viscous member (not shown). Then, as shown in FIG. 8B, the cam 55*c* becomes away from the press cam face 62*a* and comes into contact with the first cam face 62*c*.

Figure 8C:
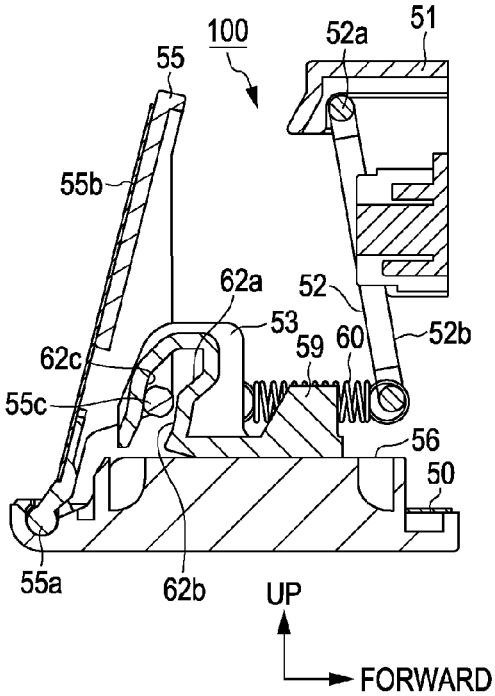

After that, when the slider 53 moves forward due to the contraction of the tension coil spring 60 with resistance of the viscous member (not shown), the cam 55*c* slides downward on the first cam face 62*c*, as shown in FIG. 8C. as the cam 55*c* slides on the first cam face 62*c*, the stopper 55 gradually rotates about the shaft 55*a* in the clockwise direction as seen from the right side.

Figure 8D:
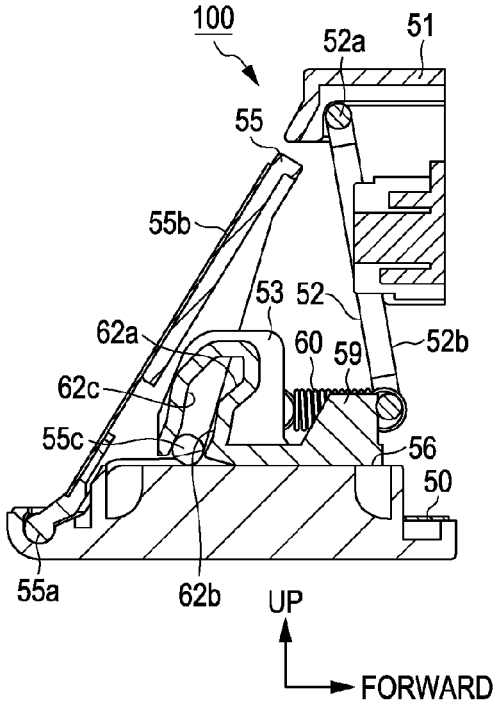

When the slider 53 moves forward to maximum due to the contraction of the tension coil spring 60 with the resistance of the viscous member (not shown), the cam 55*c* slides to the lower end of the first cam face 62*c* and the stopper 55 becomes inclined at a maximum, as shown in FIG. 8D. The positions of the stopper 55 and the slider 53 are defined as the release position and the second position, respectively.

When the stopper 55 is in the release position, since the control of the movement of the paper sheet P is released, that is, the paper sheet P is allowed to be moved in the forward direction, the movement of the paper sheet P from the cassette 20 to the separation slope 21*a* is not disturbed by the stopper 55. In contrast, when the slider 53 is in the second position, the engagement member 59 abuts (engages) the lower end of the first lever 52*b*.

Accordingly, in the ink jet printer 11 according to this embodiment, the stopper 55 rotates from the control position to the release position with a time lag (with a time delay) after the timing when the cassette 20 is mounted in the mounting unit 13. Therefore, the stopper 55 can prevent the paper sheet P from moving in the forward direction during mounting of the cassette 20 into the mounting unit 13. Moreover, it is also possible that the stopper 55 does not disturb the transportation of the paper sheet P during transporting the paper sheet P from the cassette 20 to the separation slope 21*a*.

In addition, when the cassette 20 is removed in the backward direction from the mounting unit 13 in order to replenish the paper sheets P in the cassette 20 after the paper sheets P in the cassette 20 are used up, the lever member 52 rotates about the supported shaft 52*a* which serves as the rotation axis in the clockwise direction as seen from the right side by a biasing force of the compression coil spring 54. This causes the lower end of the first lever 52*b* to press against the engagement member 59 of the slider 53 in the backward direction.

When the slider 53 slidingly moves from the second position to the first position, the cam 55*c* comes into contact with the lower end the second cam face 62*b* and moves the second cam face 62*b* in the upward direction. This causes the stopper 55 to rotate from the release position to the control position. Then, when the cam 55*c* slides on the second cam face 62*b* and is guided to the press cam face 62*a*, the stopper 55 is positioned in the control position and the slider 53 is positioned in the first position.

According to the embodiment mentioned above in detail, the following effects can be achieved.

(1) In the damper member 100, the press cam face 62*a* of the slider 53 has an inclination relative to the reference straight line K which is greater than that relative to the straight line L. Accordingly, the impact of the paper sheet P coming into contact with the stopper 55 increases the vertical component F2 of the force F which is exerted by the cam 55*c* on the press cam face 62*a*, thereby capable of reducing the horizontal component F1 of the force F (the component of the force that moves slider 53 from the first position to the second position). Therefore, the impact of the paper sheet P coming into contact with the stopper 55 can restrain the slider 53 to move from the first position to the second position by the force F exerted by the cam 55*c* on the press cam face 62*a*. As a result, the impact of the paper sheet P coming into contact with the stopper 55 can restrain the stopper 55 to rotate from the control position to the release position, thereby enabling the stopper 55 to fully control the movement of the paper sheet P in the forward direction.

(2) In the damper member 100, the angle between the press cam face 62*a* of the slider 53 and the reference straight line K is set to 90 degrees or less. Therefore, when the slider 53 slidingly moves from the first position to the second position, the cam 55*c* pressing against the press cam face 62*a* can smoothly move to the first cam face 62*c* so as to come into contact with the first cam face 62*c*.

(3) In the damper member 100, since the press cam face 62*a* of the slider 53 is formed in a flat shape, variations in shape of the press cam face 62*a* can be reduced compared with the press cam face 62*a* formed in a curved shape.

(4) In the damper member 100, the slider 53 includes the second cam face 62*b* on which the cam 55*c* is guided to the press cam face 62*a* when the slider 53 moves from the second position to the first position. When the slider 53 moves from the second position to the first position, the cam 55*c* slides on the second cam face 62*b* to the press cam face 62*a*, therefore, the stopper 55 can smoothly move from the release position to the control position.

(5) In the damper member 100, the angle between the second cam face 62*b* and the reference straight line K is smaller than the angle between the press cam face 62*a* and the reference straight line K. Therefore, the amount of rotation of the stopper 55 from the release position to the control position can be obtained with a relatively small amount of movement of the slider 53 from the second position to the first position. This contributes to downsizing of the damper member 100.

(6) In the damper member 100, since the press cam face 62*a* and the second cam face 62*b* are continuous, the size of the slider 53 can be reduced and the number of components constituting the slider 53 can be reduced compared with the case where the press cam face 62*a* and the second cam face 62*b* are formed spaced from each other. If the press cam face 62*a* and the second cam face 62*b* are not continuous, the press cam face 62*a* and the second cam face 62*b* need to be formed side by side in left-right direction, or alternatively, two the sliders 53 need to be formed, with one of the sliders 53 having the press cam face 62*a* and the other of the sliders 53 having the second cam face 62*b*.

Modified Embodiment

The above-mentioned embodiment can be modified as follows in another embodiment.

Figure 9:
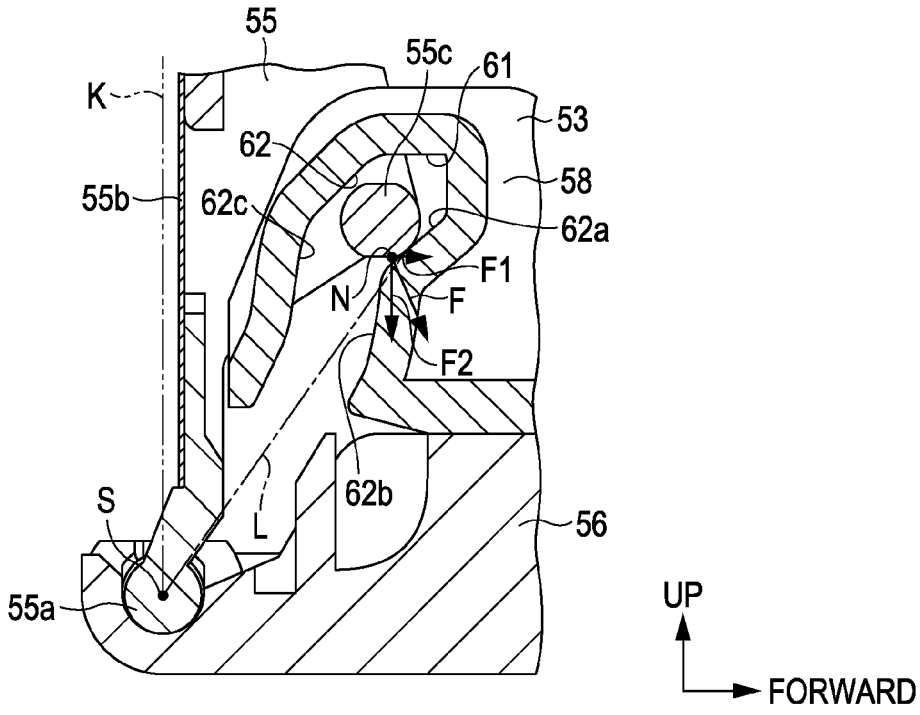
FIG. 9 is an enlarged sectional view of the essential part of a printer according to a modified embodiment which shows a cam that presses a press cam face of a slider.

As shown in FIG. 9, in the damper member 100, the press cam face 62*a* of the slider 53 may be formed so as to have an angle of 90 degrees relative to the reference straight line K. With this configuration, the vertical component F2 of the force F exerted by the cam 55*c* on the press cam face 62*a* due to the impact of the paper sheet P coming into contact with the stopper 55 can be maximized and the horizontal component F1 of the force F can be minimized. Therefore, the movement of the slider 53 from the first position to the second position by the force F exerted by the cam 55*c* on the press cam face 62*a* due to the impact of the paper sheet P coming into contact with the stopper 55 can be effectively reduced. As a result, the rotation of the stopper 55 from the control position to the release position due to the impact of the paper sheet P coming into contact with the stopper 55 can be effectively reduced the stopper 55, thereby controlling the movement of the paper sheet P in the forward direction in a highly effective manner.

In the damper member 100, the angle of the press cam face 62*a* may be modified as appropriate. With this configuration, the force F exerted by the cam 55*c* on the press cam face 62*a* due to the impact of the paper sheet P coming into contact with the stopper 55 can be divided into the horizontal component F1 and the vertical component F2 with various percentages. That is, the tasks to receive the force F can be allocated to the rigidity of the damper member 100 (the task to receive the vertical component F2 of the force F) and the damper force of the damper member 100 (the task to receive the horizontal component F1 of the force F) with various percentages. It is noted that, as the angle between the press cam face 62*a* and the horizontal plane decreases, the vertical component F2 of the force F exerted by the cam 55*c* on the press cam face 62*a* becomes larger and the horizontal component F1 becomes smaller.

In the damper member 100, the press cam face 62*a* and the second cam face 62*b* of the slider 53 may not necessarily be continuous. That is, the press cam face 62*a* and the second cam face 62*b* may be formed side by side in the left-right direction, or alternatively, two sliders 53 may be formed, with one of the sliders 53 having the press cam face 62*a* and the other of the sliders 53 having the second cam face 62*b*.

In the damper member 100, the angle between the second cam face 62*b* of the slider 53 and the reference straight line K may not necessarily be smaller than the angle between the press cam face 62*a* and the reference straight line K.

In the damper member 100, the second cam face 62*b* of the slider 53 may be omitted.

In the damper member 100, the press cam face 62*a* of the slider 53 may not necessarily be flat but may be curved.

In the damper member 100, the angle between the press cam face 62*a* of the slider 53 and the reference straight line K may be over 90 degrees.

The ink jet printer 11 may be configured such that the insertion direction of the cassette 20 into the mounting unit 13 may be angled relative to the horizontal plane.

A thin plastic film or metal plate may be used as an object of recording instead of the paper sheet P.

The ink jet printer 11 may be so-called line head printer in which a recording head is provided in a fixed position and ejects ink onto the paper sheet which is transported under the recording head.

Although the recording apparatus is embodied as the ink jet printer 11 in the above-mentioned embodiments, a liquid ejecting apparatus that ejects liquid other than ink may be used. The invention may be applied to various liquid ejecting apparatuses having a liquid ejecting head or the like that ejects fine liquid droplets. It is noted that the liquid droplets means a state of liquid that is ejected from the liquid ejecting apparatuses and are intended to include those in a particle, tear drop or string shape. Further, the liquid as described herein may be any material that can be ejected from liquid ejecting apparatuses. For example, it may include a material in liquid phase such as liquid having high or low viscosity, sol, gel water, other inorganic solvent, organic solvent and liquid solution, and a material in melted state such as liquid resin and liquid metal (molten metal). Further, in addition to a material in a liquid state, it may include particles of functional material made of solid substance such as pigment and metal particles, which is dissolved, dispersed or mixed in a solvent. Further, typical examples of liquid include ink as mentioned above, liquid crystal and the like. The ink as described herein includes various liquid components such as general water-based ink, oil-based ink, gel ink and hot melt ink. Specific examples of liquid ejecting apparatus may include, for example, liquid ejecting apparatuses that eject liquid containing materials such as electrode material and color material in a dispersed or dissolved state, which are used for manufacturing of liquid crystal displays, EL (electroluminescence) displays, surface emitting displays or color filters, liquid ejecting apparatuses that eject bioorganic materials used for manufacturing biochips, liquid ejecting apparatuses that are used as a precision pipette and eject liquid of a sample, textile printing apparatuses and micro dispensers. Further, examples of fluid ejecting apparatus may also include liquid ejecting apparatuses that eject lubricant to precision instrument such as a clock or camera in a pinpoint manner, liquid ejecting apparatuses that eject transparent resin liquid such as ultraviolet cured resin onto a substrate for manufacturing of minute hemispheric lenses (optical lenses) used for optical communication elements or the like, and liquid ejecting apparatuses that eject acid or alkali etching liquid for etching a substrate or the like. The invention may be applied to any of the above-mentioned liquid ejecting apparatuses.

What is claimed is:

1. A recording apparatus comprising:

a shaft that forms at a lower end of a control member and is rotatably supported by a seat member;

the control member that is configured to control the movement of an object contained in a container by coming into contact with the object when the object moves in an insertion direction from the container; and a damper member that rotates the control member from a control position where the movement of the object is controlled to a release position where the control of the movement of the object is released with a time delay, the damper member including a moving member that has a cam face with which a cam of the control member comes into sliding contact and moves in the insertion direction from a first position to a second position with a resistance when the container is inserted into the mounting unit, wherein the cam face includes a first cam face on which the cam slides when the moving member moves from the first position to the second position and a press cam face that is arranged so as to oppose the first cam face and against which the cam presses when the object comes into contact with the control member, and the press cam face has an inclination relative to a reference straight line which is perpendicular to a plane parallel to the insertion direction of the container which is greater than that relative to a straight line which extends from the contact point between the press cam face and the cam to the shaft.

2. The recording apparatus according to claim 1, wherein an angle between the press cam face and the reference straight line is 90 degrees or less.

3. The recording apparatus according to claim 1, wherein the press cam face is flat.

4. The recording apparatus according to claim 1, wherein the moving member includes a second cam face on which the cam is guided to the press cam face when the moving member moves from the second position to the first position.

5. The recording apparatus according to claim 4, wherein an angle between the second cam face and the reference straight line is smaller than the angle between the press cam face and the reference straight line.

6. The recording apparatus according to claim 4, wherein the press cam face and the second cam face are continuous.

* * * * *